US010349172B1

(12) United States Patent
Huang et al.

(10) Patent No.: US 10,349,172 B1
(45) Date of Patent: Jul. 9, 2019

(54) MICROPHONE APPARATUS AND METHOD OF ADJUSTING DIRECTIVITY THEREOF

(71) Applicant: Fortemedia, Inc., Santa Clara, CA (US)

(72) Inventors: Yen-Son Paul Huang, Los Altos Hills, CA (US); Tsung-Lung Yang, Hsinchu (TW)

(73) Assignee: FORTEMEDIA, INC., Santa Clara, CA (US)

( * ) Notice: Subject to any disclaimer, the term of this patent is extended or adjusted under 35 U.S.C. 154(b) by 0 days.

(21) Appl. No.: 16/057,904

(22) Filed: Aug. 8, 2018

(51) Int. Cl.

| | |
|---|---|
| ***H04R 19/04*** | (2006.01) |
| ***H04R 3/04*** | (2006.01) |
| ***H04R 1/04*** | (2006.01) |
| ***H04R 3/00*** | (2006.01) |
| ***H04R 1/40*** | (2006.01) |

(52) U.S. Cl.
CPC ..... *H04R 3/005* (2013.01); *H04R 1/04* (2013.01); *H04R 1/406* (2013.01); *H04R 3/04* (2013.01); *H04R 19/04* (2013.01); *H04R 2201/003* (2013.01); *H04R 2410/01* (2013.01)

(58) Field of Classification Search
CPC ..... H04R 3/005; H04R 1/04; H04R 1/406; H04R 3/04; H04R 19/04; H04R 2201/003; H04R 2410/01
USPC ..... 381/71.1, 92, 358, 361, 357, 174, 321, 381/375
See application file for complete search history.

(56) References Cited

U.S. PATENT DOCUMENTS

| | | | | |
|---|---|---|---|---|
| 6,820,048 | B1 * | 11/2004 | Bhutani | G06F 17/5022 703/15 |
| 9,202,475 | B2 * | 12/2015 | Elko | H04R 3/005 |
| 9,866,308 | B1 * | 1/2018 | Bultan | G01S 3/8006 |
| 2011/0317023 | A1 * | 12/2011 | Tsuda | H04R 1/406 348/207.99 |
| 2012/0093336 | A1 * | 4/2012 | Said | G01S 5/18 381/92 |
| 2014/0148224 | A1 * | 5/2014 | Truong | H04M 9/085 455/557 |
| 2014/0161295 | A1 * | 6/2014 | Huang | H04R 1/406 381/357 |

(Continued)

*Primary Examiner* — Paul Kim
*Assistant Examiner* — Friedrich Fahnert
(74) *Attorney, Agent, or Firm* — McClure, Qualey & Rodack, LLP

(57) ABSTRACT

A microphone apparatus is provided. The microphone apparatus includes a microphone cover; a circuit board, an integrated circuit, a first microphone, and a second microphone. The integrated circuit is coupled to the microphone cover and the circuit board to form a first chamber and a second chamber. The first microphone is placed inside the first chamber and configured to capture a first acoustic signal from a sound source. The second microphone is placed inside the second chamber and configured to capture a second acoustic signal from the sound source. The first microphone and the second microphone have the same sensitivity, phase, and omni-directivity. The integrated circuit performs a time-delay process on the second acoustic signal and subtracts the time-delayed second acoustic signal from the first acoustic signal to generate a differential signal. The integrated circuit forms a polar pattern of the microphone apparatus according to the differential signal.

17 Claims, 14 Drawing Sheets

(56) References Cited

U.S. PATENT DOCUMENTS

2014/0348370 A1* 11/2014 Huang ..... H04R 1/08
381/361

* cited by examiner

MICROPHONE APPARATUS AND METHOD OF ADJUSTING DIRECTIVITY THEREOF

BACKGROUND OF THE INVENTION

Field of the Invention

The present invention relates to a microphone apparatus, and, in particular, to a microphone apparatus and a method of adjusting the directivity thereof.

Description of the Related Art

Currently, most microphone apparatuses are capacitive microphones in which micro-electro mechanical system (MEMS) microphones are widely used. A MEMS microphone uses MEMS, which can integrate electronic, electrical, and mechanical functions into a single device. Therefore, a MEMS microphone may have the advantages of a small size, low power consumption, easy packaging, and resistance to interference.

In general, a microphone apparatus having multiple microphones (e.g., a MEMS microphone) can perform better due to its higher sensitivity and better noise-to-signal ratio. Adopting multiple microphones may increase the total size of the microphone apparatus and affect the applications using the microphone apparatus.

In addition, the signal-to-noise ratio and directivity of the microphone array in the microphone apparatus can be improved by deploying the design of sound guides into the microphone apparatus to extend the distance between the microphones in the microphone array. However, if fixed sound guides are used in the microphone apparatus to extend the distance between the microphones in the microphone array, the polar patterns of the microphones may have a fixed directivity. If the position of the source of the speech or noise changes, the microphone array may provide erroneous acoustic signals to a subsequent noise-cancelling procedure, resulting in a low speech-recognition rate.

Accordingly, there is demand for a microphone apparatus and a method of adjusting the directivity thereof to solve the aforementioned problems.

BRIEF SUMMARY OF THE INVENTION

A detailed description is given in the following embodiments with reference to the accompanying drawings.

In an exemplary embodiment, a microphone apparatus is provided. The microphone apparatus includes a microphone cover, a circuit board, an integrated circuit, a first microphone, and a second microphone. The circuit board is coupled to the microphone cover. The circuit board includes a first acoustic port and a second acoustic port. The integrated circuit is coupled to the microphone cover and the circuit board to form a first chamber and a second chamber. The first microphone is placed inside the first chamber. The first microphone is configured to capture a first acoustic signal from a sound source through the first acoustic port. The second microphone is placed inside the second chamber. The second microphone is configured to capture a second acoustic signal from the sound source through the second acoustic port. The first microphone and the second microphone have the same sensitivity, phase, and omni-directivity. The integrated circuit is coupled to the first microphone and the second microphone. The integrated circuit is configured to perform a time-delay process on the second acoustic signal, subtract the time-delayed second acoustic signal from the first acoustic signal to generate a differential signal, and form a polar pattern for the microphone apparatus according to the differential signal.

In another exemplary embodiment, a method of adjusting directivity for use in a microphone apparatus is provided. The microphone apparatus includes a microphone cover, a circuit board, an integrated circuit, a first microphone, and a second microphone. The circuit board is coupled to the microphone cover including a first acoustic port and a second acoustic port. The integrated circuit is coupled to the microphone cover and the circuit board to form a first chamber and a second chamber. The first microphone is placed inside the first chamber and the second microphone is placed inside the second chamber. The method includes the steps of: utilizing the first microphone and the second microphone to respectively capture a first acoustic signal and a second acoustic signal from a sound source through the first acoustic port and the second acoustic port, wherein the first microphone and the second microphone have the same sensitivity, phase, and omni-directivity; utilizing the integrated circuit to perform a time-delay process on the second acoustic signal; subtracting the time-delayed second acoustic signal from the first acoustic signal to generate a differential signal; and forming a polar pattern of the microphone apparatus according to the differential signal.

In yet another exemplary embodiment, an electronic device is provided. The electronic device includes a processor and at least three microphone apparatuses that were described in the above-mentioned embodiment. The microphone apparatuses are disposed in different positions of an enclosure of the electronic device. The processor is configured to calculate the source direction of a sound source and the distance between the sound source and the electronic device based on a first acoustic signal and a second acoustic signal that are respectively captured by the first microphone and the second microphone in each microphone apparatus. Furthermore, the processor automatically switches the polar pattern of each microphone apparatus to be directional or omni-directional, depending on the calculated distance between the sound source and the electronic device.

BRIEF DESCRIPTION OF THE DRAWINGS

The present invention can be more fully understood by reading the subsequent detailed description and examples with references made to the accompanying drawings, wherein.

DETAILED DESCRIPTION OF THE INVENTION

The following description is made for the purpose of illustrating the general principles of the invention and should not be taken in a limiting sense. The scope of the invention is best determined by reference to the appended claims.

Figure 1:
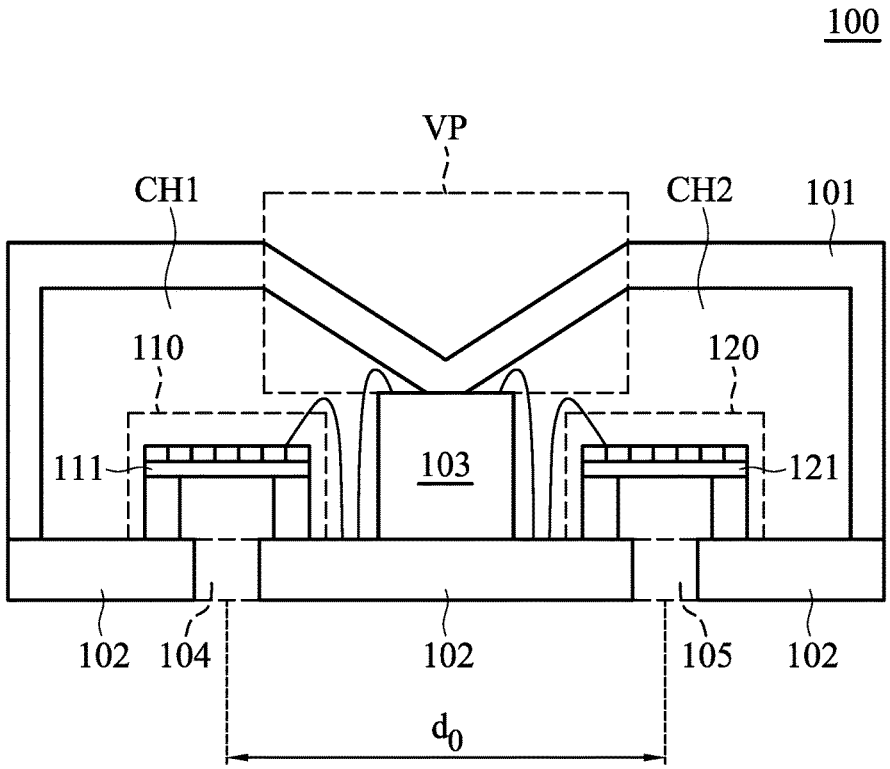
FIG. 1 is a schematic diagram of the microphone apparatus 100 in accordance with an embodiment of the invention.

FIG. 1 is a schematic diagram of a microphone apparatus in accordance with an embodiment of the invention. The microphone apparatus 100 includes a microphone cover 101, a circuit board 102, an integrated circuit 103, microphones 110 and 120. The integrated circuit 103 is coupled to the microphone cover 101 and the circuit board 102 to form the chamber CH1 and chamber CH2. The microphone 110 in the chamber CH1 includes diaphragm 111. The microphone 120 in the chamber CH2 includes diaphragm 121. The circuit board 102 is coupled to the microphone cover 101 and includes sound ports 104 and 105, and the distance between the sound ports 104 and 105 is d0. in an embodiment, the microphone 110 and the microphone 120 have the same sensitivity, phase, and omni-directivity In some embodiments, the microphones 110 and 120 are micro-electro mechanical system (MEMS) devices that form a microphone array. In some embodiments, the integrated circuit 103 may be an application-specific integrated circuit which includes a digital circuit (e.g., the circuit which can perform digital-signal-processing (DSP)), an analog circuit (e.g., operational amplifier), and an analog-to-digital convertor. In some other embodiments, the integrated circuit 103 may be a digital signal processor (DSP) or a microcontroller.

In some embodiments, the digital circuit of the integrated circuit 103 may have built-in algorithms (such as Time Difference of Arrival (TDOA), Differential Microphone Arrays (DMA), or Adaptive Differential Microphone Arrays (ADMA) Algorithm) to allow the microphone apparatus 100 to support lots of functions. For example, based on parameters (such as the distance and orientation of the speech source, the sound volume of background sounds, etc.) corresponding to the environment outside the microphone apparatus 100, the digital circuit of the microphone apparatus 100 may automatically change the operation mode (e.g., switching to an operation mode having a better SNR), dynamic range (e.g., switching to a wider dynamic range), and direction or angle of the directivity of the beam formed by the microphone array using the aforementioned algorithm. Furthermore, the analog circuit (e.g., the operational amplifier) of the integrated circuit 103 may respectively provide the same or different voltages to the microphones to adjust sensitivity and volume gain of the microphone apparatus 100.

In some embodiments, the integrated circuit 103 is directly connected to the microphones 110 and 120 and is capable of controlling the microphones 110 and 120. In some embodiments, the integrated circuit 103 is connected to the circuit board 102 via a conductor (or conductive wires), and coupled to the microphones 110 and 120 via other conductors (or conductive wires), thereby providing voltages to the microphones 110 and 120 and processing signals (generated by the sound) received from the microphones 110 and 120.

In some embodiments, the material of the microphone cover 101 is metal that forms the groove VP on the microphone cover 101. On the other hand, if the material of the microphone cover 101 is metal, the thickness of the microphone cover 101 can be reduced and still have enough rigidity, which reduces the size of the microphone apparatus 100.

In some embodiments, since the integrated circuit 103 of the microphone apparatus 100 is designed as one of the components which forms the chambers CH1 and CH2 (e.g., the integrated circuit 103 is coupled to the microphone cover 101 and the circuit board 102), the wall structure generally utilized to form the chambers CH1 and CH2 is replaced by the part of the integrated circuit 103, which reduces the size of the microphone apparatus 100, and the size of the chamber of each microphone can be enlarged. Accordingly, the sensitivity of each microphone in the microphone array can be improved, resulting in a higher SNR of the microphone array.

In some embodiments, the chambers CH1 and CH2 are the same size. Furthermore, the arrangement of the microphone 110 and the integrated circuit 103 in the chamber CH1 is the same as the arrangement of the microphone 120 and the integrated circuit 103 in the chamber CH2. In such cases, the environment corresponding to the microphone 110 is substantially the same as the environment corresponding to the microphone 120. Therefore, when the integrated circuit 103 processes the signal received from the microphones 110 and 120 and performs a function related to the directivity of the microphone apparatus 100, the effects caused by the difference between the environment of the microphone 110 and the environment of the microphone 120 can be reduced, which improves the accuracy of the directivity of the microphone apparatus 100.

In some embodiments, the chambers CH1 and CH2 are the same size, and the arrangement of the microphone 110 and the integrated circuit 103 in the chamber CH1 is the same as the arrangement of the microphone 120 and the integrated circuit 103 in the chamber CH2. In such cases, the circuit arrangement in the chamber CH1 can be designed to be the same as the circuit arrangement in the chamber CH2 without placing an individual integrated circuit in each chamber (e.g., chambers CH1 and CH2). Therefore, the size of the microphone apparatus 100 can be reduced.

In some embodiments, the integrated circuit 103 may provide the same voltage to the microphones 110 and 120, which makes the distance between the diaphragm 111 and the back-plate (not shown in FIG. 1) of the microphone 110 the same as the distance between the diaphragm 121 and the back-plate (not shown in FIG. 1) of the microphone 120. In such cases, the sensitivity of the microphone 110 is the same as the sensitivity of the microphone 120, which improves the SNR of the microphone apparatus 100. In some embodiments, the integrated circuit 103 can dynamically adjust the volume gain of the microphone apparatus 100 to let the acoustic overload point (AOP) be 140 dB.

As shown in FIG. 1, the acoustic port 104 corresponds to the position of the diaphragm 111 (which makes the diaphragm 111 can receive sound through the acoustic port 104), and the acoustic port 105 corresponds to the position of the diaphragm 121 (which makes the diaphragm 121 can receive sound through the acoustic port 105). In some embodiments, the first sound wave transmitted from outside of the microphone apparatus 100 may transmit to the microphones 110 and 120 through the acoustic ports 104 and 105, respectively. Based on the distance $d_0$ between the acoustic ports 104 and 105, a first part and a second part of the first sound wave may respectively reach the diaphragm 111 and diaphragm 121 at the same time if the first sound wave is transmitted in a specific direction, which makes the microphone apparatus 100 perform directivity. In some embodiments, the distance d0 is the distance between the central points of the acoustic ports 104 and 105.

In some embodiments, the sound wave propagated from the acoustic port 104 to the diaphragm 111 (e.g., the first part of the first sound wave) is not transmitted to the diaphragm 121, and the sound wave propagated from the acoustic port 105 to the diaphragm 121 (e.g., the second part of the first sound wave) is not transmitted to the diaphragm 111. In such cases, the microphone 110 of the chamber CH1 is not interrupted by the sound wave transmitted to the microphone 120 of the chamber CH2. Similarly, the microphone 120 of the chamber CH2 is not interrupted by the sound wave transmitted to the microphone 110 of the chamber CH1. Accordingly, the noise respectively received by the microphones 110 and 120 is reduced, and the performance of the directivity of the microphone apparatus 100 is improved.

Figure 2:
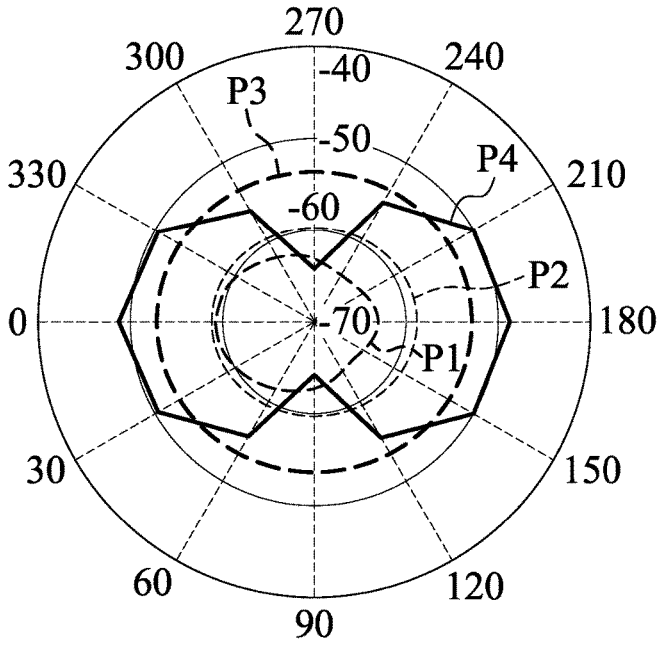
FIG. 2 is a diagram of the polar pattern of the microphone apparatus in accordance with an embodiment of the invention.

FIG. 2 is a diagram of the polar pattern of the microphone apparatus in accordance with an embodiment of the invention.

Referring to FIG. 1 and FIG. 2, in some embodiments, the integrated circuit 103 may control the directivity of the microphone apparatus 100 by controlling the microphones 110 and 120 and processing the signals received from the microphones 110 and 120. For example, the integrated circuit 103 may add an additional time delay to the signal received from the microphone 110 or the microphone 120 to automatically adjust the directivity of the microphone apparatus 100. In some embodiments, the integrated circuit 103 may perform active or passive TDOA algorithm with the assistance of the algorithm of virtual microphone signals to perform better speech-recognition, and the details will be described later. In addition, the acoustic ports 104 and 105 (e.g., front/back acoustic ports) are located on the same planar surface, and receive acoustic signals respectively by diaphragm 111 and diaphragm 112. After the integrated circuit 103 has received the two acoustic signals received by the microphones 110 and 120 corresponding to the diaphragms 111 and 112, the integrated circuit 103 may perform logical operations on the two received acoustic signals to automatically adjust the directivity of the microphone apparatus 100 to be omni-directional, and the sensitivity of the omni-directivity can be improved by 6 dB.

For example, if the microphones 110 and 120 have the same sensitivity, the polar pattern P2 may indicate the acoustic signal $X_F$ received by the microphone 110 or the acoustic signal $X_B$ received by the microphone 120. The polar pattern P3 may indicate the result by adding the acoustic signals $X_F$ and $X_B$. The polar pattern P1 may indicate the result of subtracting the acoustic signal $X_B$ from the acoustic signal $X_F$. The integrated circuit 103 may perform operations on the polar patterns P1~P3 to obtain the polar pattern P4. Compared with the polar pattern P2, the polar pattern P4 has a better sensitivity by 8 dB in the front (e.g., 0 degree) and in the back (e.g., 180 degrees), and has a better noise-cancelling effect at two sides such as 270 and 90 degrees.

Figure 3:
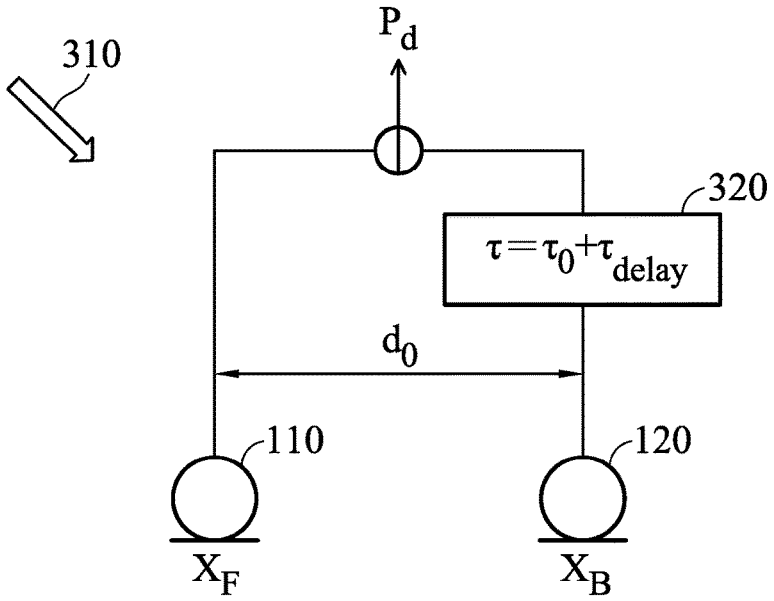
FIG. 3 is a diagram of the delay process of the digital signals in accordance with an embodiment of the invention.

FIG. 3 is a diagram of the delay process of the digital signals in accordance with an embodiment of the invention. In an embodiment, the sound source is from direction 310, and the acoustic signals received by the microphones 110 and 120 are $X_F$ and $X_B$, respectively. Since there is a distance d0 between the microphones 110 and 120, the acoustic signal XB received by the microphone 120 has a time delay $\tau_0$ in comparison with the acoustic signal XF received by the microphone 110, where the time delay $\tau_0$ can be expressed by equation (1):

$$\tau_0 = \frac{d_0}{c} \tag{1}$$

where $d_0$ denotes the distance between the microphones 110 and 120; and c denotes the sound speed.

However, it should be noted that since the size of the microphone apparatus is very small, the distance d0 between the microphones 110 and 120 is also very short. Accordingly, the low-frequency components of the acoustic signals $X_F$ and $X_B$ respectively received by the microphones 110 and 120 are also similar, and the calculated time delay $\tau_0$ is also very short. Thus, the time delay $\tau_0$ is not suitable for the subsequent digital signal processes performed by the integrated circuit 103.

In an embodiment, the integrated circuit 103 may add a virtual time delay $\tau_{delay}$ into the acoustic signal received by the microphone 110 or the microphone 120 using a finite-impulse-response filter (FIR filter) 320. For example, in the embodiment of FIG. 3, the integrated circuit 103 may add a virtual time delay $\tau_{delay}$ into the acoustic signal $X_B$ received by the microphone 120, and the integrated circuit 103 further subtract the delayed acoustic signal $X_B'$ having the time delay $\tau_0$ and the virtual time delay $\tau_{delay}$ from the acoustic signal $X_F$ received by the microphone 110 to obtain a differential signal $P_d$. Then, the integrated circuit 103 may use the differential signal $P_d$ in the subsequent operations.

Specifically, when the directivity of the microphone apparatus 100 is calculated using the acoustic signals received by the microphones in the microphone array (e.g., microphones 110 and 120), a longer distance between every two microphones within an appropriate range is better for the calculation. That is, if the distance between every two microphones is longer than the distance $d_0$, the time delay between the acoustic signals from the same sound source received by the microphones in the microphone array is also longer, and thus the SNR of the microphone array may become larger. However, the distance between the microphones in the microphone array is limited by the size of the microphone apparatus, and thus a method for virtually extending the distance between the microphones in the microphone array is provided in the invention to facilitate the subsequent noise-cancelling calculations performed by the integrated circuit 103. In an embodiment, when the integrated circuit 103 is a digital-signal process, the integrated circuit may implement the FIR filter using software to add the virtual time delay $\tau_{delay}$ into the acoustic signal received by the microphone 110 or the microphone 120. In another embodiment, when the integrated circuit 103 is an application-specific integrated circuit (ASIC), the FIR filter can be implemented by hardware logic circuits to add the virtual time delay $\tau_{delay}$ into the acoustic signal received by the microphone 110 or the microphone 120. It should be noted that no matter whether the FIR filter is implemented using software or hardware, the virtual time delay $\tau_{delay}$ is adjustable, and can be adjusted separately in accordance with different frequency bands.

Since the size of the microphone apparatus 100 is very small and the distance between the microphones 110 and 120 is very short (e.g., 5 mm), the calculated value of the time delay $\tau_0$ is also very small. After adding the virtual time delay $\tau_{delay}$ into the acoustic signal $X_B$ received by the microphone 120, the virtually-delayed acoustic signal $X_B'$ and the acoustic signal $X_F$ can be regarded as being respectively received by microphones 110 and 120 via the acoustic ports 104 and 105 spaced a distance of $c*(\tau_0+\tau_{delay})$ from each other. In an embodiment, the distance d0 between the microphones 110 and 120 can be virtually extended to about 10 mm, and a better result of beamforming can be achieved. Accordingly, the integrated circuit 103 may increase the difference of the sound pressure of the acoustic signals received from the acoustic ports 104 and 105, thereby facilitating the subsequent noise-cancelling calculations.

Figure 9A:
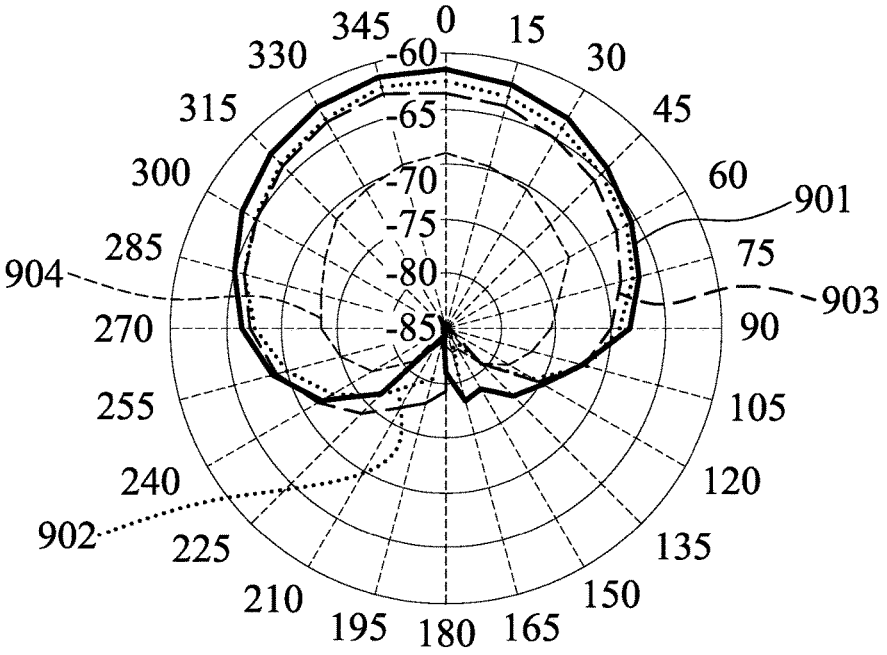
FIG. 9A is a diagram of polar patterns of the microphone apparatus using different configurations of sound guides in accordance with an embodiment of the invention.

As illustrated in FIG. 9A, when the distance d0 between the microphones 110 and 120 is 5 mm, the microphone apparatus 100 has a polar pattern 904. If a symmetrical physical sound guide with a length of 10 mm is implemented in the position of each of the acoustic ports 104 and 105, the microphone apparatus 100 may have a polar pattern 902. If an asymmetrical physical sound guide with a length of 10 mm is implemented in the position of each of the acoustic ports 104 and 105, the microphone apparatus 100 may have a polar pattern 901. If the distance between the microphones 110 and 120 is virtually extended to 10 mm using the virtual sound guide provided in the invention, the microphone apparatus 100 may have a polar pattern 903.

Specifically, since the design of physical sound guides may take up too much space, it may not meet demands for a lighter and thinner microphone apparatus 100. In the present invention, no physical sound guide is required in the microphone apparatus 100, and the design of virtual sound guides is used in the microphone apparatus 100 to virtually extend the distance between the microphones 110 and 120, thereby improving the sensitivity of the polar pattern 903 of the microphone apparatus 100. For example, the sensitivity of the polar pattern 903 is close to that of the polar pattern 901 or 902 with the design of symmetrical or asymmetrical physical sound guides, and thus the overall SNR of the microphone apparatus 100 is improved, thereby achieving a higher speech-recognition rate.

In some other embodiments, the differential signal $P_d$ can be expressed by equation (2)

$$P_d=X_F-X_B*\tau \tag{2}$$

where the time delay $\tau$ is associated with the time delay $\tau_0$, and the time delay $\tau$ can be expressed by equation (3):

$$\tau=\beta*\tau_0 \tag{3}$$

where $\beta$ is a constant, and $0\leq\beta\leq1$.

Figure 4A:
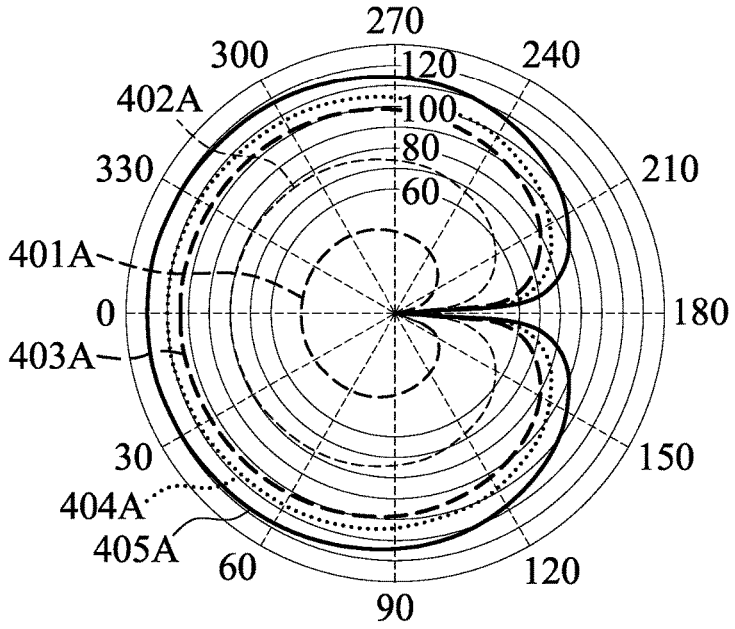
FIGS. 4A-4C are diagrams of the polar patterns of the microphone apparatus in accordance with an embodiment of the invention.

After substituting the acoustic signals $X_F$ and $X_B$ and associated time delay values into equation (2), the polar pattern of the microphone apparatus 100 can be obtained, as illustrated in FIG. 4A. For example, the polar patterns 401A-405A correspond to frequency bands 1~5, respectively. The center frequencies of the frequency bands 1~5 may be 20 Hz, 1 KHz, 16 KHz, 32 KHz, and 96 KHz, but the invention is not limited thereto.

However, in FIG. 4A, the polar patterns 401A-405A have similar shapes, but the size of the polar pattern may become larger as the frequency increases from low to high. That is, the polar patterns in FIG. 4A may vary in response to the frequency.

In some embodiments, the design of virtual sound guides is used in the microphone apparatus 100 to virtually extend the distance between the microphones 110 and 120. In addition, in order to facilitate calculations in the time domain, the frequencies of the received acoustic signals by the microphones 110 and 120 can be classified into frequency bands 1~5, and the virtually-extended distance of each frequency band can be calculated by equation (4):

$$d_0=n_i*d_{ext} \tag{4}$$

where i is an positive integer between 1 to 5 which denotes frequency bands 1~5; $n_i$ denotes the multiplying factor of the i-th frequency band.

Then, the calculated distance $d_0$ calculated by equation (4) is substituted into equation (5):

$$\tau=\beta*\frac{d_0}{c} \tag{5}$$

Figure 4B:
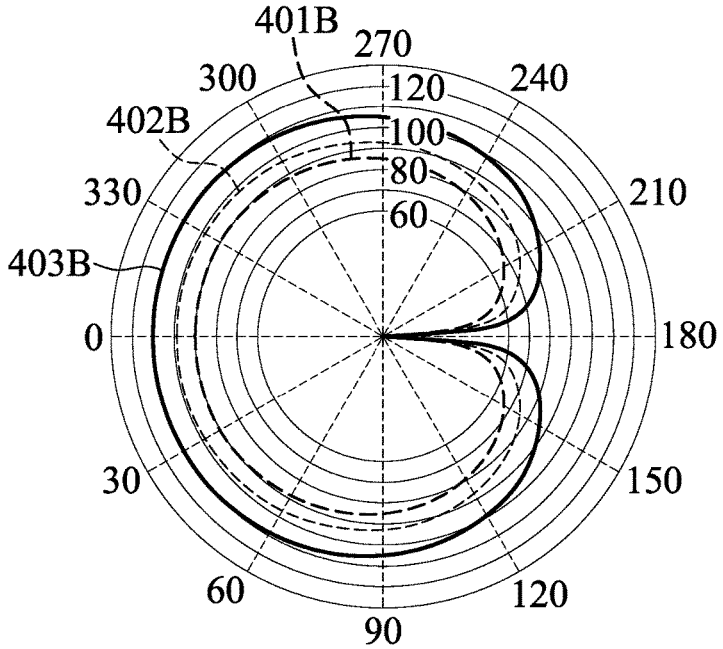

Then, the calculated time delay $\tau$ calculated by equation (5) can be further substituted into equation (2) to calculate the differential signal $P_d$. Meanwhile, the differential signal may form the polar patterns 401B~405B shown in FIG. 4B. The polar patterns 404B and 405B of frequency bands 4 and 5 are not shown in FIG. 4B since they are overlapped with the polar pattern 403B of frequency band 3. In addition, the size of the polar patterns in FIG. 4B is less likely to be affected by increment of the frequency. For example, at angle 0, the gap between the polar patterns 401A and 402A in FIG. 4A has been shrunk to a smaller gap between the polar patterns 401B and 402B in FIG. 4B.

In addition, an equalization function can be added to the integrated circuit 103, different time delays $EQ_d_{ext}$ for different frequency bands can be calculated using equation (6):

$$EQ_d_{ext}=\frac{w*n_i*d_{ext}}{w_c} \tag{6}$$

where w denotes frequency; and $w_c$ denotes another frequency that can be expressed by equation (7):

$$w_c=\frac{\pi}{\tau_A+\tau} \tag{7}$$

Figure 4C:
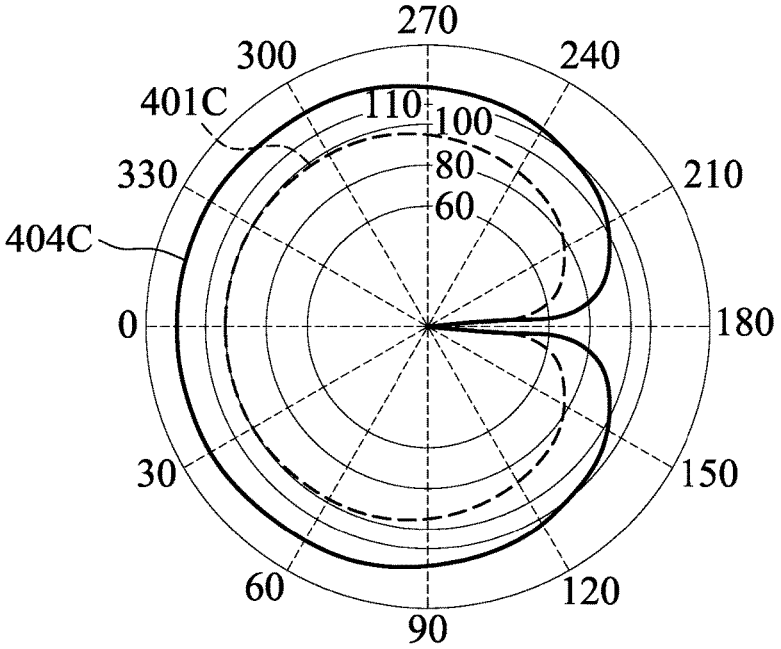

The integrated circuit 103 may substitute the calculated $EQ_d_{ext}$ value for each of the frequency bands into the parameter $d_{ext}$ in the corresponding frequency band in equations (2), (4), and (5), and thus the polar patterns 401C-405C can be obtained, as illustrated in FIG. 4C. For example, the polar patterns 401C-403C corresponding to the frequency bands 1~3 are overlapped at the position of the polar pattern 401C. Thus, the polarity of the microphone apparatus 100 is not associated with the frequency in the frequency bands 1~3. In some embodiments, the values of $n_i$ for the frequency bands 1~5 may be 160, 8, 2, 1, and 0.33, but the invention is not limited thereto. For example, the frequency band having a lower frequency range may have a longer time delay, and the frequency band having a higher frequency range may have a shorter time delay. That is, the time delay becomes shorter as the frequency becomes higher in the equalization function.

Figure 5A:
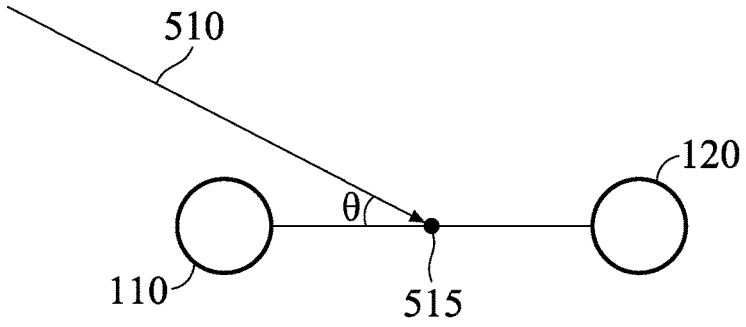
FIG. 5A is a diagram of receiving an acoustic signal by microphones in the microphone apparatus in accordance with an embodiment of the invention.
Figure 5B:
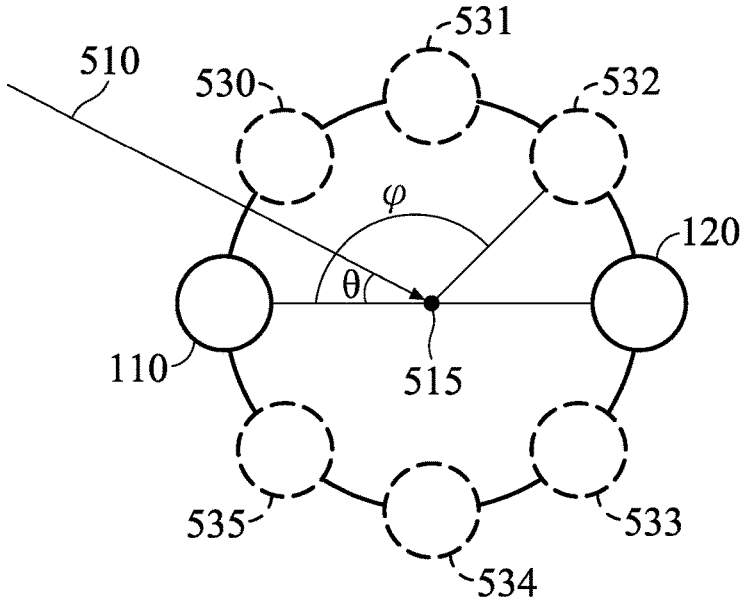
FIG. 5B is a diagram of positions of virtual microphones of the microphone apparatus in accordance with an embodiment of the invention.

FIG. 5A is a diagram of receiving an acoustic signal by microphones in the microphone apparatus in accordance with an embodiment of the invention. FIG. 5B is a diagram of positions of virtual microphones of the microphone apparatus in accordance with an embodiment of the invention.

As illustrated in FIG. 5A, the microphones 110 and 120 in the microphone apparatus 100 may receive an acoustic signal from direction 510, where the acoustic signal has an incident angle θ relative to the center 515 of the line segment between microphones 110 and 120. In an embodiment, as illustrated in FIG. 5B, the integrated circuit 103 may calculate virtual microphones at different positions, such as virtual microphones 530~535, on the virtual circle 520 with a diameter formed by the line segment between the microphones 110 and 120 according to the acoustic signals received by the microphones 110 and 120. For example, there is an inner angle φ between the line segment between the virtual microphone 532 and the center 515 and the line segment between the microphones 110 and 120.

It should be noted that the number of virtual microphones on the virtual circle 520 can be determined based on practical conditions and the performance of the integrated circuit 103, and the invention is not limited to the aforementioned number of virtual microphones. For example, if the spacing angle between every two neighboring virtual microphones is smaller, the number of virtual microphones is also greater. However, it may increase the computation complexity of the integrated circuit 103. In an embodiment, the spacing angle between two neighboring microphones or virtual microphones on the virtual circle 520 may be 15 degrees, but the invention is not limited thereto.

Figure 5C:
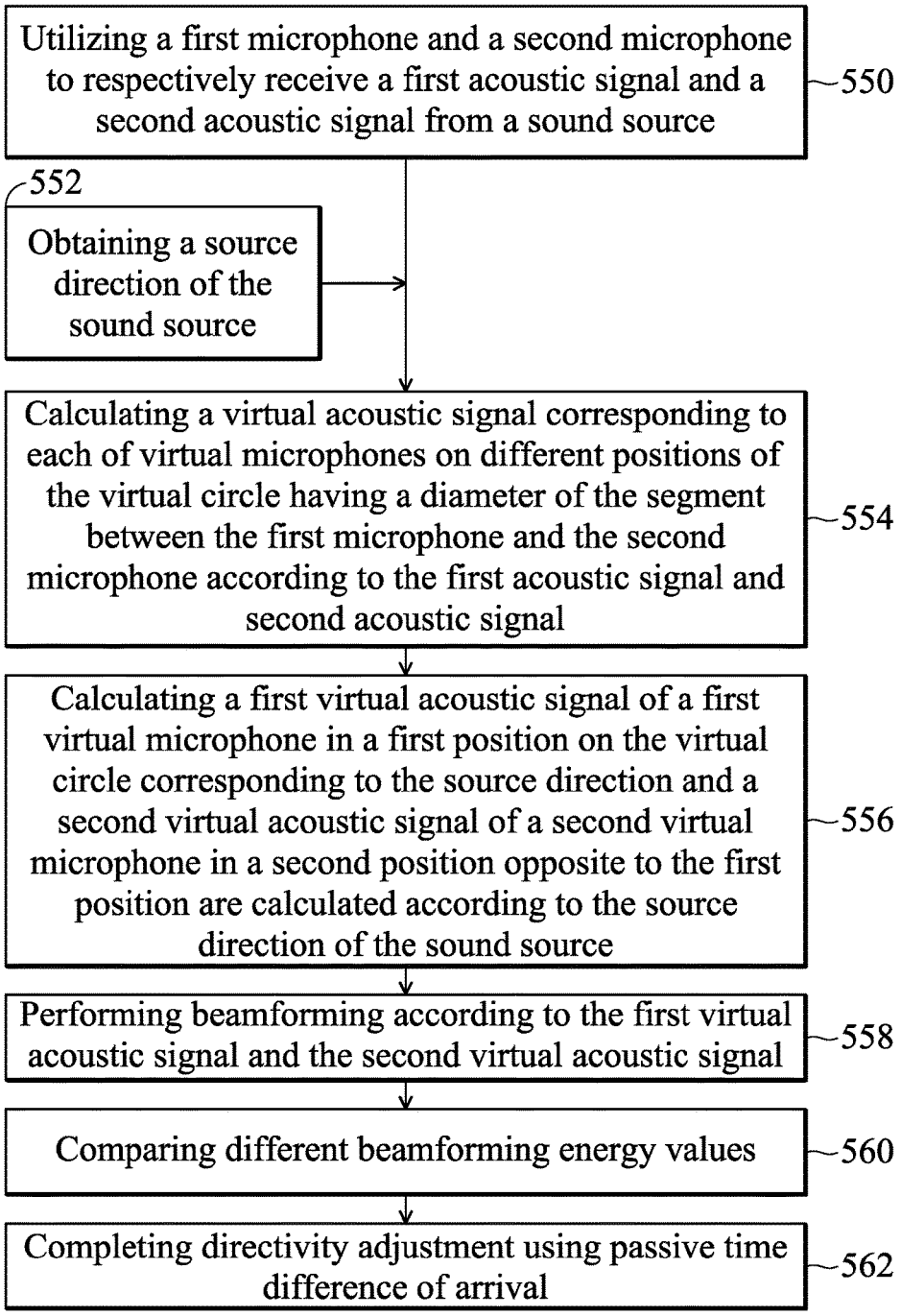
FIG. 5C is a diagram of a method of adjusting directivity using passive time difference of arrival in accordance with an embodiment of the invention.

FIG. 5C is a diagram of a method of adjusting directivity using passive time difference of arrival in accordance with an embodiment of the invention.

Referring to FIGS. 5A~5C, in the embodiments of FIG. 5A and FIG. 5B, the integrated circuit 103 may calculate virtual microphones at different positions, such as virtual microphones 530~535, on the virtual circle 520 with a diameter formed by the line segment between the microphones 110 and 120 according to the acoustic signals received by the microphones 110 and 120. The integrated circuit 103 may perform calculations of time difference of arrival and beamforming using the microphones and virtual microphones in different positions on the virtual circle, so that the microphone apparatus 100 may have a better sensitivity toward a specific direction.

In block 550, a first microphone (e.g., microphone 110) and a second microphone (e.g., microphone 120) are utilized to respectively receive a first acoustic signal and a second acoustic signal from a sound source. For example, the microphones 110 and 120 in the microphone apparatus 110 may receive the first acoustic signal and the second acoustic signal of the source from direction 510, wherein the acoustic signal from the sound source has an incident angle θ relative to the center 515 of the line segment between microphones 110 and 120.

In block 552, a source direction of the sound source is obtained. For example, when the microphone apparatus (e.g., a frontend apparatus) 100 is disposed on an electronic device (e.g., a smartphone), the integrated circuit of the microphone apparatus 100 may have limitations about power consumption and performance, and thus the integrated circuit 103 will not perform complicated calculations such as calculating the source direction of the sound source. Accordingly, the central processing unit (e.g., a backend computation device) of the electronic device having more system resources may calculate the source direction of the sound source according to the acoustic signals received by the microphone apparatus 100 or sensor data of other types of sensors disposed in the electronic device, and inform the microphone apparatus 100 of the source direction of the sound source.

In block 554, a virtual acoustic signal corresponding to each of the virtual microphones in different positions of the virtual circle having a diameter formed by the line segment between the first microphone and the second microphone is calculated according to the first acoustic signal and second acoustic signal. In an embodiment, the integrated circuit 103 may use interpolation or extrapolation to calculate the virtual acoustic signal corresponding to each of the virtual microphones in different positions of the virtual circle according to the first acoustic signal and the second acoustic signal. In another embodiment, the integrated circuit 103 may obtain a pre-built lookup table that is used to convert the first acoustic signal and the second acoustic signal to the virtual acoustic signals of each of the virtual microphones on the virtual circle. For example, the lookup table records the interpolation and extrapolation relationships between the first acoustic signal, the second acoustic signal, and the virtual acoustic signal corresponding to each of the virtual microphones in different positions of the virtual circle.

In block 556, a first virtual acoustic signal of a first virtual microphone in a first position (e.g., 0 degree relative to the source direction) on the virtual circle corresponding to the source direction and a second virtual acoustic signal of a second virtual microphone in a second position (e.g., 180 degrees relative to the source direction) opposite to the first position are calculated according to the source direction of the sound source. For example, the integrated circuit 103 may determine a virtual-microphone inner angle (e.g., the inner angle φ in FIG. 5B) according to the source direction of the sound source, and determine the first position and the second position according to the virtual-microphone inner angle. In some embodiments, blocks 554 and 556 can be integrated into one step. For example, the source direction of the sound direction can be directly obtained, and then the first virtual acoustic signal of the first virtual microphone in the first location and the second virtual acoustic signal of the second virtual microphone in the second location can be calculated or obtained using the lookup table.

In block 558, beamforming is performed according to the first virtual acoustic signal and the second virtual acoustic signal. For example, the method for adding a time delay into the first acoustic signal or the second acoustic signal described in the aforementioned embodiments can be applied to the first virtual acoustic signal and the second virtual acoustic signal. In the embodiment, for example, the integrated circuit 103 may add the time delay into the second virtual acoustic signal.

In block 560, different beamforming energy values are compared. For example, the central processing unit of the electronic device may compare the beamforming energy values formed by virtual acoustic signals of the virtual microphone on each of the different positions of the virtual circle and another virtual microphone in the opposite position of the virtual circle. Theoretically, the virtual microphone that is closest to the sound source has the largest beamforming energy value (i.e., highest sound pressure), and thus central processing unit of the electronic device may determine whether the virtual microphone in the correct position is selected according to the beamforming energy values.

In block 562, directivity adjustment using passive time difference of arrival is completed.

In the embodiment, if the source direction of the sound source received by the integrated circuit 103 has been changed to the position of 90 degrees, the integrated circuit 103 may select the virtual microphone 531 and 534 in FIG. 5B as the first microphone and the second microphone, respectively. That is, the polar pattern can be rotated by 90 degrees. Accordingly, the polar pattern 580 without rotation in FIG. 5D can be changed to the polar pattern 582 with a rotation angle of 90 degrees, thereby changing the directivity of the microphone apparatus 100.

Figure 6:
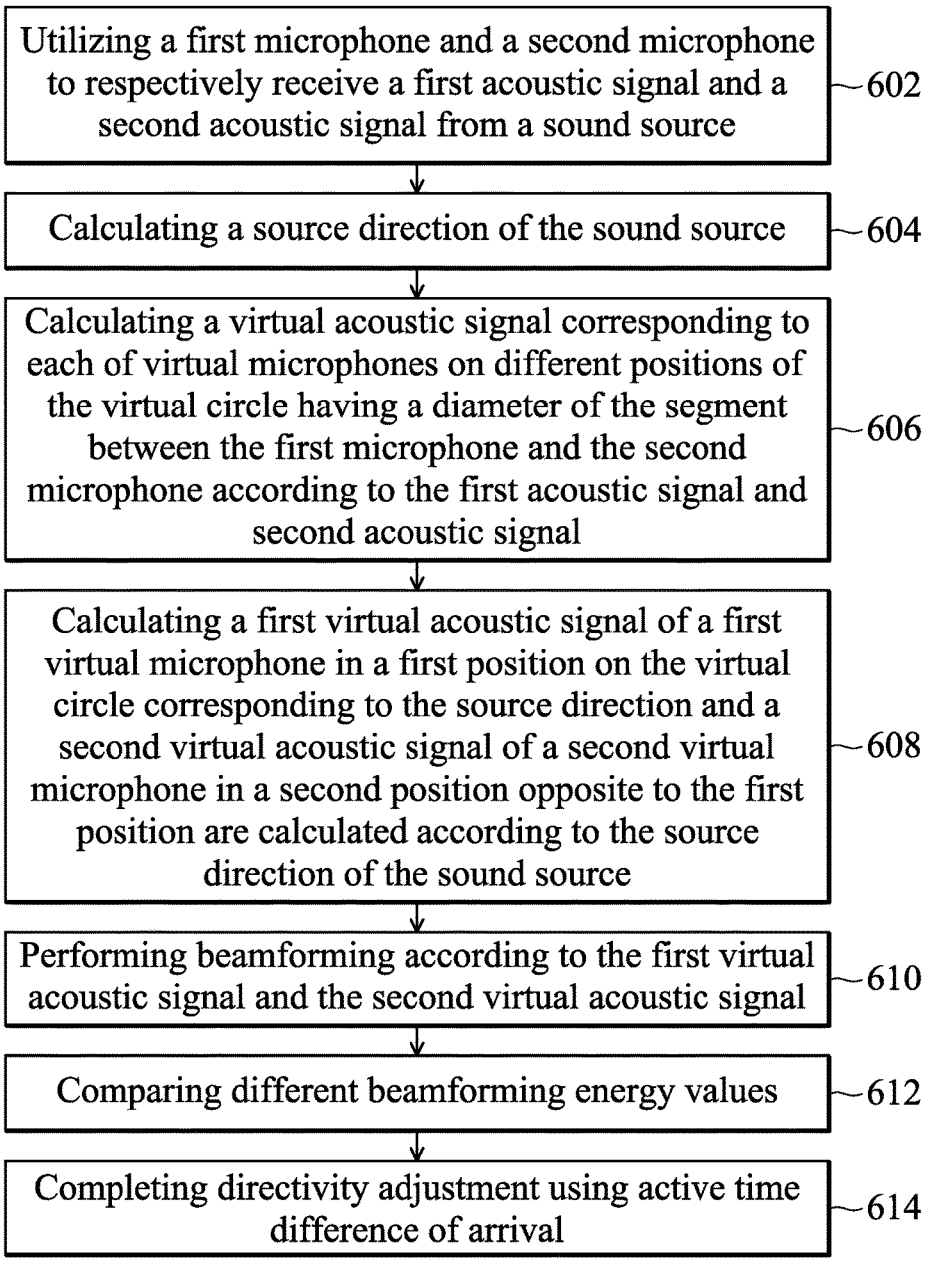
FIG. 6 is a diagram of a method of adjusting directivity using active time difference of arrival in accordance with an embodiment of the invention.

FIG. 6 is a diagram of a method of adjusting directivity using active time difference of arrival in accordance with an embodiment of the invention.

Figure 5D:
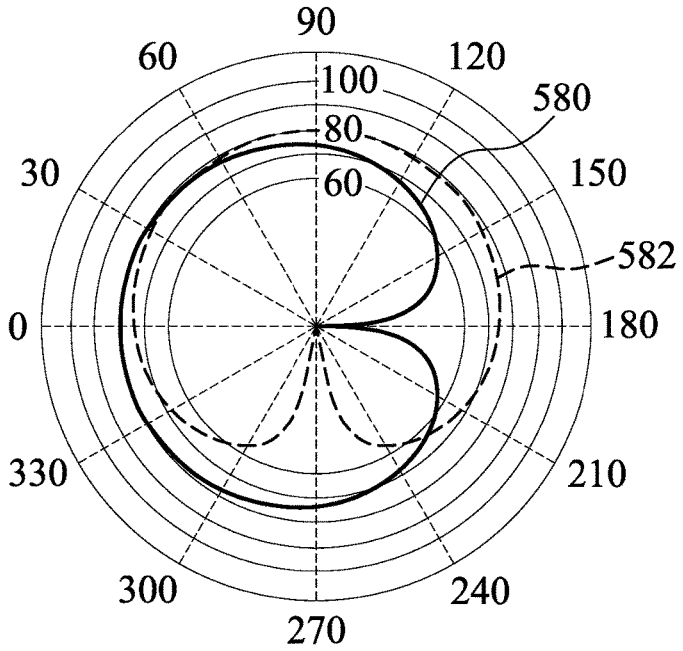
FIG. 5D is a diagram of the original polar pattern and the changed polar pattern of the microphone apparatus in accordance with an embodiment of the invention.

Referring to FIG. 5B, FIG. 5D, and FIG. 6, in block 602, a first microphone (e.g., microphone 110) and a second microphone (e.g., microphone 120) are utilized to respectively receive a first acoustic signal and a second acoustic signal from a sound source. For example, the microphones 110 and 120 in the microphone apparatus 110 may receive the first acoustic signal and the second acoustic signal of the source from direction 510, wherein the acoustic signal from the sound source has an incident angle θ relative to the center 515 of the line segment between microphones 110 and 120.

In block 604, a source direction of the sound source is calculated. In the embodiment, when the microphone apparatus (e.g., a frontend apparatus) 100 is disposed on an electronic device (e.g., a smartphone), the integrated circuit 103 of the microphone apparatus 100 is capable of performing complicated calculations. For example, the integrated circuit 103 may calculate the source direction of the sound source according to the first acoustic signal and the second acoustic signal, such as determining the direction of the acoustic signal having the maximum sound pressure as the source direction. There is an inner angle (e.g., the inner angle φ in FIG. 5B) between the source direction and the line segment between the first microphone and the second microphone, and the inner angle is between negative 180 degrees and positive 180 degrees. For example, the inner angle between from 0 to positive 180 degrees belongs to the right plane, and the inner angle from 0 to negative 180 degrees belongs to the left plane.

In block 606, a virtual acoustic signal corresponding to each of the virtual microphones in different positions of the virtual circle having a diameter of the line segment between the first microphone and the second microphone is calculated according to the first acoustic signal and second acoustic signal. In an embodiment, the integrated circuit 103 may use interpolation or extrapolation to calculate the virtual acoustic signal corresponding to each of the virtual microphones in different positions of the virtual circle according to the first acoustic signal and the second acoustic signal. In another embodiment, the integrated circuit 103 may obtain a pre-built lookup table that is used to convert the first acoustic signal and the second acoustic signal to the virtual acoustic signals of each of the virtual microphones on the virtual circle. For example, the lookup table records the interpolation and extrapolation relationships between the first acoustic signal, the second acoustic signal, and the virtual acoustic signal corresponding to each of the virtual microphones in different positions of the virtual circle.

In block 608, a first virtual acoustic signal of a first virtual microphone in a first position (e.g., 0 degree relative to the source direction) on the virtual circle corresponding to the source direction and a second virtual acoustic signal of a second virtual microphone in a second position (e.g., 180 degrees relative to the source direction) opposite to the first position are calculated according to the source direction of the sound source. For example, the integrated circuit 103 may determine a virtual-microphone inner angle (e.g., the inner angle φ in FIG. 5B) according to the source direction of the sound source, and determine the first position and the second position according to the virtual-microphone inner angle. In some embodiments, blocks 554 and 556 can be integrated into one step. For example, the source direction of the sound direction can be directly obtained, and then the first virtual acoustic signal of the first virtual microphone in the first location and the second virtual acoustic signal of the second virtual microphone in the second location can be calculated or obtained using the lookup table.

In block 610, beamforming is performed according to the first virtual acoustic signal and the second virtual acoustic signal. For example, the method for adding a time delay into the first acoustic signal or the second acoustic signal described in the aforementioned embodiments can be applied to the first virtual acoustic signal and the second virtual acoustic signal. In the embodiment, for example, the integrated circuit 103 may add the time delay into the second virtual acoustic signal, and thus a Cardioid polar pattern can be obtained after performing beamforming.

In block 612, different beamforming energy values are compared. For example, the central processing unit of the electronic device may compare the beamforming energy values formed by virtual acoustic signals of the virtual microphone on each of the different positions of the virtual circle and another virtual microphone in the opposite position of the virtual circle. Theoretically, the virtual microphone that is closest to the sound source has the largest beamforming energy value (i.e., highest sound pressure), and thus central processing unit of the electronic device may determine whether the virtual microphone on the correct position is selected according to the beamforming energy values.

In block 614, directivity adjustment using active time difference of arrival is completed.

In the embodiment, if the source direction of the sound source received by the integrated circuit 103 has been changed to the position of degree 90, the integrated circuit 103 may select the virtual microphone 531 and 534 in FIG. 5B as the first microphone and the second microphone, respectively. That is, the polar pattern can be rotated by 90 degrees. Accordingly, the polar pattern 580 without rotation in FIG. 5D can be changed to the polar pattern 582 with a rotation angle of 90 degrees, thereby changing the directivity of the microphone apparatus 100. Specifically, the technique of active time difference of arrival can be used to real-time track the moving angle of the sound source and update the polar pattern of the microphone array, so that the angle having the highest sensitivity in the updated polar pattern may direct toward the source direction of the sound source.

Figure 9B:
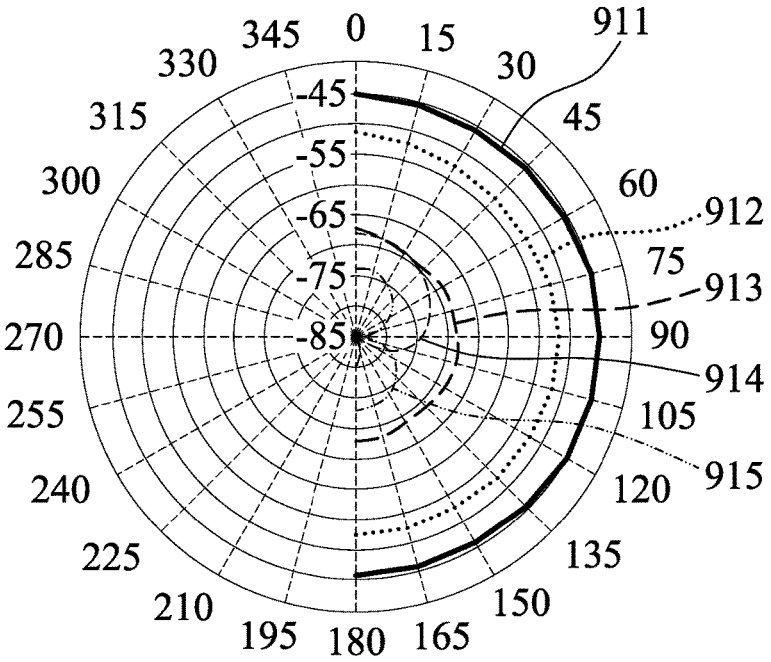
FIG. 9B is a diagram of the polar pattern of the microphone array using different configurations in accordance with an embodiment of the invention.

For example, FIG. 9B is a diagram of polar patterns on the right plane of different configurations of the microphone apparatus in accordance with an embodiment of the invention. The polar pattern 914 is a Cardioid polar pattern such as the original polar pattern of the microphone 110 or 120.

If a dipole microphone is used, it may have the polar pattern 915. After applying the techniques of virtual sound guides and active time difference of arrival, the polar pattern of the microphone array can be changed to the polar pattern 913. Thus, the sensitivity of the microphone array can be significantly improved, and the angle of the updated polar pattern having the highest sensitivity may direct toward the source direction of the sound source (e.g., the angle of 90 degrees). If omni-directional sound-collecting is used, the microphone apparatus without using the virtual sound guides (e.g., in a bypass mode) may have an omni-directional polar pattern 912. After using the technique of the virtual sound guide provided in the invention, the microphone apparatus 100 may have an omni-directional polar pattern 911. In comparison with the omni-directional polar pattern 912, the sensitivity of the polar pattern 911 of the microphone apparatus 100 using the technique of the virtual sound guide may be increased by 6 dB.

Figure 7A:
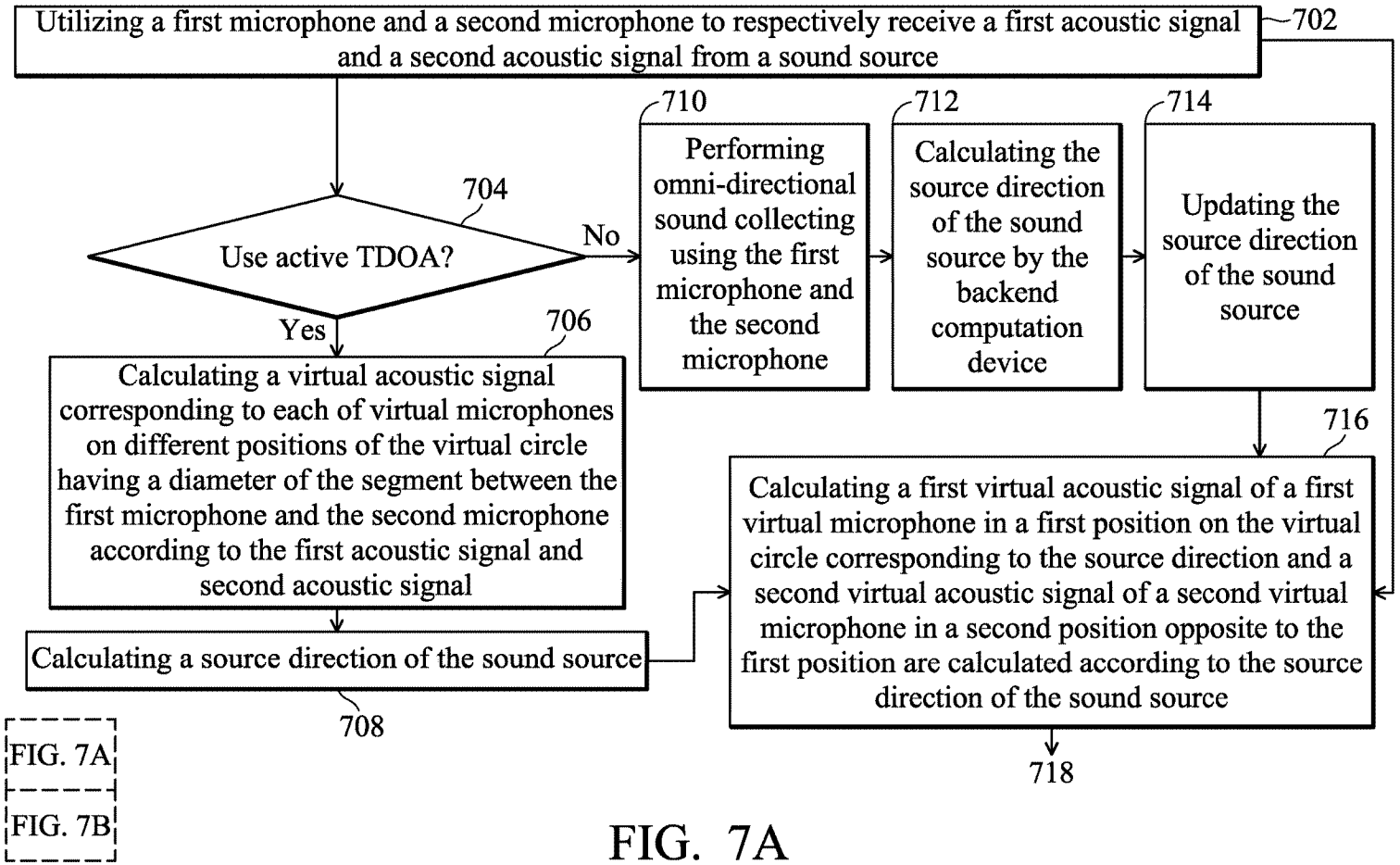
FIGS. 7A-7B are portions of a diagram of a method of adjusting directivity including active and passive time difference of arrival in accordance with an embodiment of the invention.
Figure 7B:
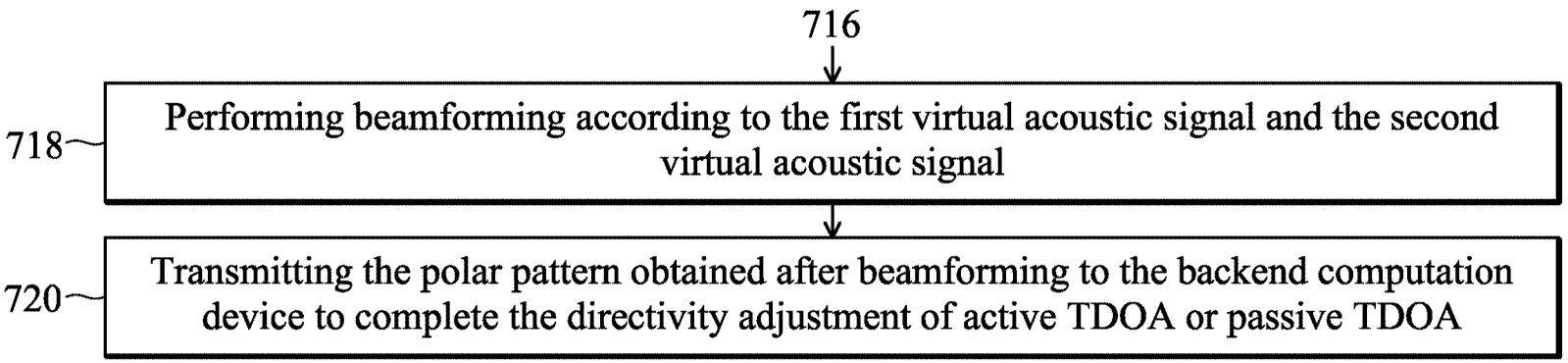

FIG. 7 is a diagram of a method of adjusting directivity including active and passive time difference of arrival in accordance with an embodiment of the invention. For example, the flow of the method of adjusting directivity using passive time difference of arrival in FIG. 5C are incorporated with the flow of the method of adjusting directivity using active time difference of arrival in FIG. 6 to obtain the flow in FIG. 7.

In block 702, a first microphone (e.g., microphone 110) and a second microphone (e.g., microphone 120) are utilized to respectively receive a first acoustic signal and a second acoustic signal from a sound source. For example, the microphones 110 and 120 in the microphone apparatus 110 may receive the first acoustic signal and the second acoustic signal of the source from direction 510.

In block 704, it is determined whether to use calculations of the active TDOA. If calculations of the active TDOA are used, the flow proceeds to block 706. If calculations of the active TDOA are not used, the flow proceeds to block 710.

In block 706, a virtual acoustic signal corresponding to each of the virtual microphones in different positions of the virtual circle having a diameter of the line segment between the first microphone and the second microphone is calculated according to the first acoustic signal and second acoustic signal.

In block 708, the source direction of the sound source is calculated. Block 708 is similar to block 604 in FIG. 6. In the embodiment, when the microphone apparatus (e.g., a frontend apparatus) 100 is disposed on an electronic device (e.g., a smartphone), the integrated circuit 103 of the microphone apparatus 100 is capable of performing complicated calculations. For example, the integrated circuit 103 may calculate the source direction of the sound source according to the first acoustic signal and the second acoustic signal, such as determining the direction of the acoustic signal having the maximum sound pressure as the source direction. There is an inner angle (e.g., the inner angle φ in FIG. 5B) between the source direction and the line segment between the first microphone and the second microphone, and the inner angle is between negative 180 degrees and positive 180 degrees. For example, the inner angle between from 0 to positive 180 degrees belongs to the right plane, and the inner angle from 0 to negative 180 degrees belongs to the left plane.

In block 710, omni-directional sound collecting is performed using the first microphone and the second microphone.

In block 712, the source direction of the sound source is calculated by the backend computation device. For example, if the determination result in block 704 is not to use the active TDOA, it indicates the microphone apparatus 100 has to perform operations of the passive TDOA. That is, the microphone apparatus 100 has to obtain the current source direction of the sound source from the backend computation device. However, the backend computation device has to use the first microphone and the second microphone to perform omni-directional sound collecting while calculating the source direction of the sound source. Meanwhile, the backend computation device may add the second acoustic signal from the second microphone to the first acoustic signal from the first microphone to obtain an omni-directional polar pattern.

In block 714, the source direction of the sound source is updated. For example, the microphone apparatus 100 may obtain the source direction from the backend computation apparatus.

In block 716, a first virtual acoustic signal of a first virtual microphone in a first position (e.g., 0 degree relative to the source direction) on the virtual circle corresponding to the source direction and a second virtual acoustic signal of a second virtual microphone in a second position (e.g., 180 degrees relative to the source direction) opposite to the first position are calculated according to the source direction of the sound source. For example, if the passive TDOA is used, the source direction of the sound source is calculated by the backend computation apparatus, and the backend computation apparatus may transmit the calculated source direction to the integrated circuit 103 of the microphone apparatus 100. If the active TDOA is used, the source direction of the sound source is calculated by the integrated circuit 103 of the microphone apparatus.

In block 718, beamforming is performed according to the first virtual acoustic signal and the second virtual acoustic signal. For example, the method for adding a time delay into the first acoustic signal or the second acoustic signal described in the aforementioned embodiments can be applied to the first virtual acoustic signal and the second virtual acoustic signal. In the embodiment, for example, the integrated circuit 103 may add the time delay into the second virtual acoustic signal, and thus a Cardioid polar pattern can be obtained after performing beamforming.

In block 720, the polar pattern obtained after beamforming is transmitted to the backend computation device to complete the directivity adjustment of active TDOA or passive TDOA. Specifically, the technique of virtual sound guides can be applied to the microphone array in the invention with active TDOA or passive TDOA to automatically track the moving position and angle of the speech source, thereby improving the speech-recognition rate and lowering the noise interferences during speech communication.

Figure 8A:
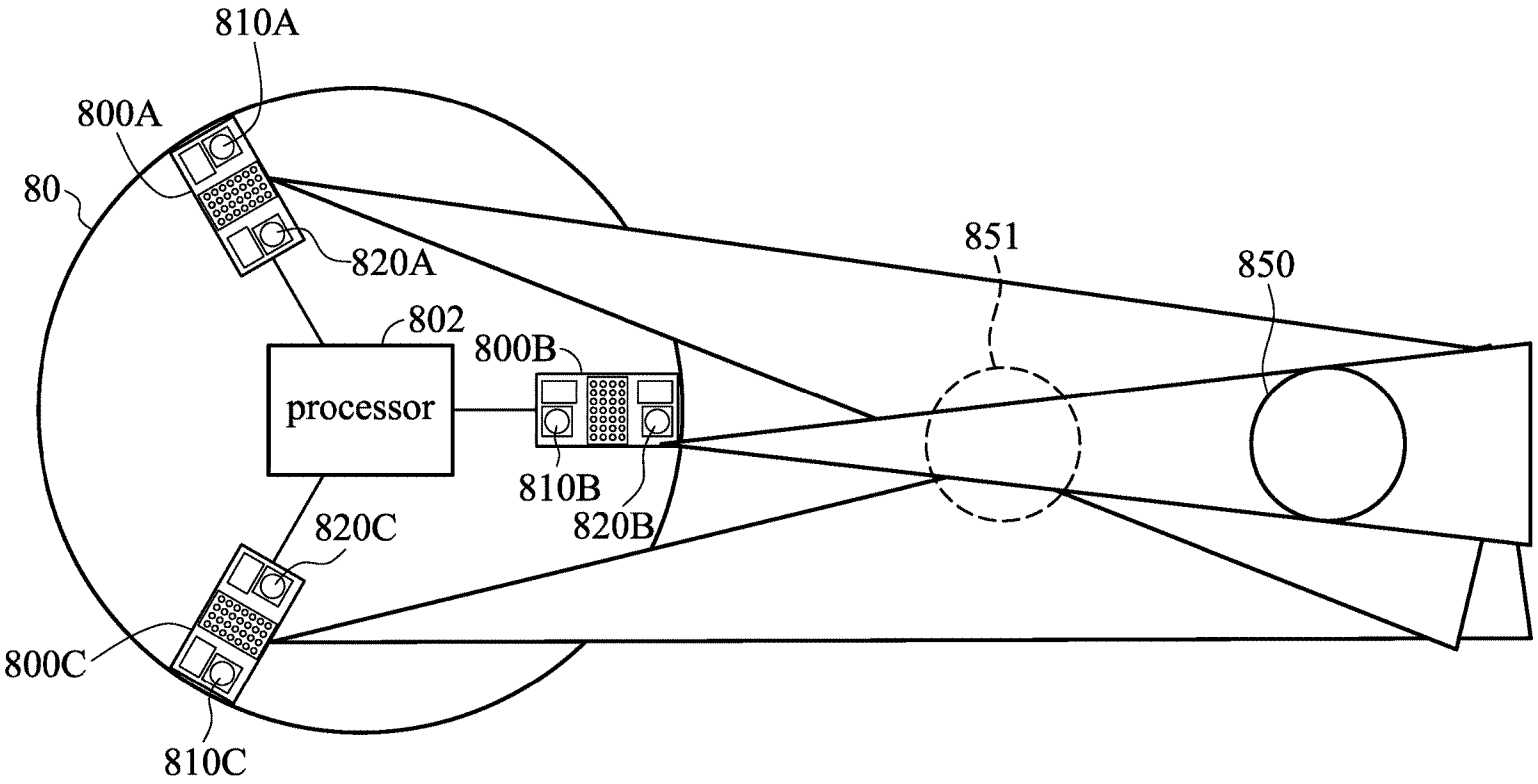
FIG. 8A is a diagram of an electronic device in accordance with an embodiment of the invention.

FIG. 8A is a diagram of an electronic device in accordance with an embodiment of the invention. FIGS. 8B~8E are diagrams of difference microphone apparatuses in accordance with the embodiment of FIG. 8A.

In an embodiment, a processor 802 and a plurality of microphone apparatuses 800A, 800B, and 800C are deployed in the electronic device 80, wherein each of the microphone apparatuses 800A, 800B, and 800C is similar to the microphone apparatus 100 in FIG. 1, and is disposed on a respective position of an enclosure of the electronic device 80, as illustrated in FIG. 8A.

Figure 8B:
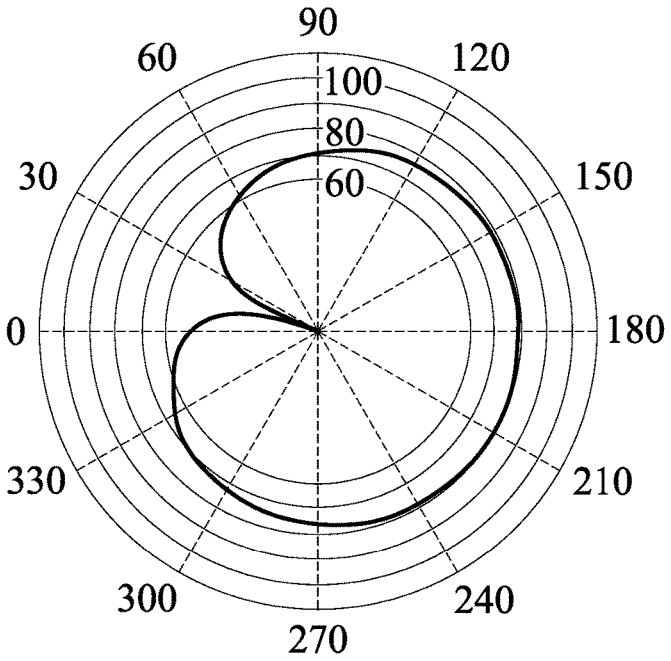
FIGS. 8B-8E are diagrams of difference microphone apparatuses in accordance with the embodiment of FIG. 8A.
Figure 8C:
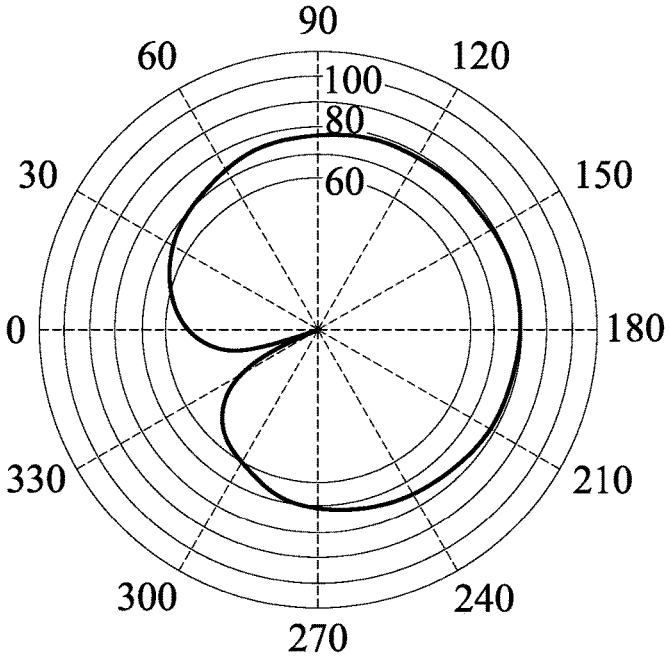
Figure 8D:
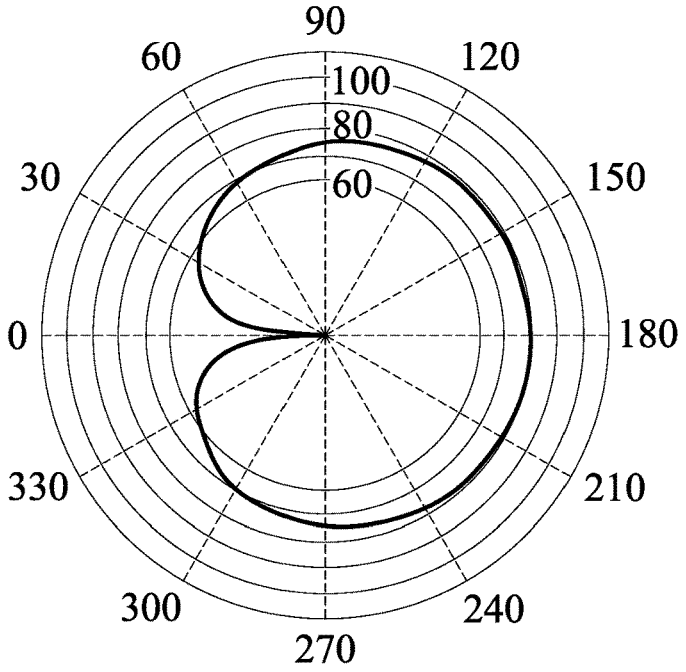

Since the microphone apparatuses 800A~800C are disposed in different positions of the electronic device 80, the microphones 810A and 820A of the microphone apparatus 800A, the microphones 810B and 820B of the microphone apparatus 800B, and the microphones 810C and 820C of the microphone apparatus 800C may capture a source acoustic signal using different directivities. Thus, polar patterns of the microphone apparatuses 800A~800C may have different directivities, as illustrated in FIG. 8B, FIG. 8C, and FIG. 8D. Specifically, the electronic device 80 may include at least three directional microphone apparatuses, and thus the processor 802 may use the acoustic signal captured by each microphone apparatuses to recognize the direction and distance of the sound source.

For example, when the electronic device 80 determines that the sound source 850 is located in a longer distance, the electronic device 80 may enter a differential-signal mode. For example, the source direction of the sound source can be calculated using the methods described in the aforementioned embodiments. Then, for the virtual circle corresponding to each of the microphone apparatuses 800A~800C, the second virtual acoustic signal of the second virtual microphone in the opposite position may be subtracted from the first virtual acoustic signal of the first virtual microphone corresponding to the source direction to obtain the polar pattern directing toward the source direction, thereby performing directional sound-collecting, as illustrated in FIG. 8A.

Figure 8E:
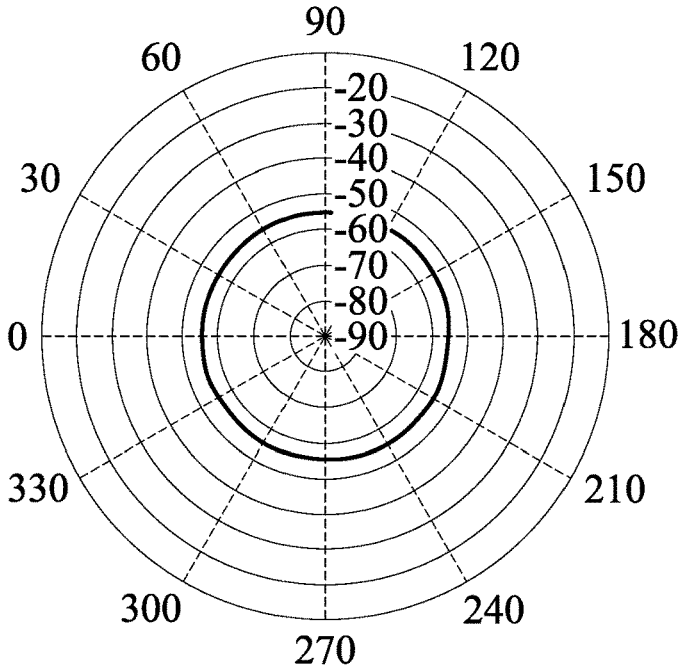

When the electronic device 80 determines that the sound source 851 is located a shorter distance away from the electronic device 80, as illustrated in FIG. 8B, the electronic device 80 may enter an additive-signal mode. For example, the acoustic signals captured by the microphones in each of the microphone apparatuses 800A~800C can be added together to obtain an omni-directional polar pattern, as illustrated in FIG. 8E. Thus, omni-directional sound collecting can be performed. In addition, the electronic device 80 may perform speech recognition and noise-cancelling analysis in a noisy or quiet environment using the methods described in the aforementioned embodiments. For example, FIGS. 8B~8D are directional Cardioid polar patterns, and thus the acoustic signal may have the highest sensitivity (e.g., highest sound strength) at the position of degree 0 of the polar patterns, and have a lower strength at the position of degree 180. Thus, noise-cancelling effect can be applied to the acoustic signal from the direction of degree 180 of the polar patterns. Accordingly, the electronic device 80 is capable of automatically switching between long/short distance sound-collecting modes and noise-cancelling analysis mode.

In view of the above, a microphone apparatus and a method of adjusting directivity are provided in the invention, the microphone apparatus and the method of adjusting directivity are capable of changing the polar pattern of the microphone apparatus by adjusting time delay of the acoustic signals captured by different microphones using software or hardware. In addition, without adjusting the position of the microphone apparatus, the microphone apparatus may use the virtual acoustic signals of the virtual microphones together with the acoustic signals from the physical microphones with the assistance of the active or passive TDOA to change the directivity of the maximum sensitivity in the polar pattern of the microphone apparatus and the width of effective beamforming. Furthermore, a plurality of microphone apparatuses can be disposed in an electronic device of the invention, and polar patterns of the microphone apparatuses may have different directivities that can be used to perform correspondence analysis of captured acoustic signals and calculate the distance of the sound source, thereby automatically switching between long/short distance sound-collecting modes and the noise-cancelling analysis mode.

While the invention has been described by way of example and in terms of the preferred embodiments, it should be understood that the invention is not limited to the disclosed embodiments. On the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A microphone apparatus, comprising:

a microphone cover;

a circuit board coupled to the microphone cover, comprising a first acoustic port and a second acoustic port;

an integrated circuit, coupled to the microphone cover and the circuit board to form a first chamber and a second chamber;

a first microphone, placed inside the first chamber, configured to capture a first acoustic signal from a sound source through the first acoustic port; and a second microphone, placed inside the second chamber, and configured to capture a second acoustic signal from the sound source through the second acoustic port, wherein the first microphone and the second microphone have the same sensitivity, phase, and omni-directivity;

wherein the integrated circuit is coupled to the first microphone and the second microphone, and is configured to perform a time-delay process on the second acoustic signal, subtract the time-delayed second acoustic signal from the first acoustic signal to generate a differential signal, and form a polar pattern for the microphone apparatus according to the differential signal, wherein the time-delay process is performed to add a different time delay to each of frequency bands in the second acoustic signal.

2. The microphone apparatus as claimed in claim 1, wherein the integrated circuit is a processor configured to perform the time-delay process.

3. The microphone apparatus as claimed in claim 1, wherein the integrated circuit is an application-specific integrated circuit configured to perform the time-delay process.

4. The microphone apparatus as claimed in claim 1, wherein when a frequency of a specific frequency band in the frequency bands is higher, the time delay corresponding to the specific frequency band is shorter.

5. The microphone apparatus as claimed in claim 1, wherein there is a first distance between the first microphone and the second microphone, and the integrated circuit calculates a plurality of virtual microphones in different positions of a virtual circle having a diameter formed by a line segment between the first microphone and the second microphone according to the first acoustic signal and the second acoustic signal.

6. The microphone apparatus as claimed in claim 5, wherein the integrated circuit obtains a source direction of the sound source from a backend computation device of an electronic device in which the microphone apparatus is disposed, and calculates a first virtual acoustic signal of a first virtual microphone located in a first position corresponding to the source direction and a second virtual acoustic signal of a second virtual microphone located in a second position opposite to the first location, wherein the integrated circuit further performs the time-delay process on the second virtual acoustic signal, and subtracts the time-delayed second virtual acoustic signal from the first virtual acoustic signal to change directivity of the polar pattern of the first microphone and the second microphone.

7. The microphone apparatus as claimed in claim 5, wherein the integrated circuit calculates a source direction of the sound source according to the first acoustic signal and the second acoustic signal, and calculates a first virtual acoustic signal of a first virtual microphone located in a first position corresponding to the source direction and a second virtual acoustic signal of a second virtual microphone located on a second position opposite to the first location, wherein the integrated circuit further performs the time-delay process on the second virtual acoustic signal, and subtracts the time-delayed second virtual acoustic signal from the first virtual acoustic signal to change directivity of the polar pattern of the first microphone and the second microphone.

8. The microphone apparatus as claimed in claim 5, wherein the time-delay process virtually increases the first distance between the first microphone and the second microphone.

9. A method of adjusting directivity for use in a microphone apparatus, wherein the microphone apparatus comprises a microphone cover; a circuit board coupled to the microphone cover, comprising a first acoustic port and a second acoustic port; an integrated circuit, coupled to the microphone cover and the circuit board to form a first chamber and a second chamber; a first microphone, placed inside the first chamber; and a second microphone, placed inside the second chamber, the method comprising:

utilizing the first microphone and the second microphone to respectively capture a first acoustic signal and a second acoustic signal from a sound source through the first acoustic port and the second acoustic port, wherein the first microphone and the second microphone have the same sensitivity, phase, and omni-directivity;

utilizing the integrated circuit to perform a time-delay process on the second acoustic signal, wherein the time-delay process is performed to add a different time delay to each of frequency bands in the second acoustic signal;

subtracting the time-delayed second acoustic signal from the first acoustic signal to generate a differential signal; and forming a polar pattern of the microphone apparatus according to the differential signal.

10. The method as claimed in claim 9, wherein the integrated circuit is a processor configured to perform the time-delay process.

11. The method as claimed in claim 9, wherein the integrated circuit is an application-specific integrated circuit configured to perform the time-delay process.

12. The method as claimed in claim 9, wherein when a frequency of a specific frequency band in the frequency bands is higher, the time delay corresponding to the specific frequency band is shorter.

13. The method as claimed in claim 9, wherein there is a first distance between the first microphone and the second microphone, and the method further comprises: utilizing the integrated circuit to calculate a plurality of virtual microphones in different positions of a virtual circle having a diameter formed by a line segment between the first microphone and the second microphone according to the first acoustic signal and the second acoustic signal.

14. The method as claimed in claim 13, further comprising:

obtaining a source direction of the sound source from a backend computation device of an electronic device in which the microphone apparatus is disposed;

calculating a first virtual acoustic signal of a first virtual microphone located in a first position corresponding to the source direction and a second virtual acoustic signal of a second virtual microphone located in a second position opposite to the first location; and performing the time-delay process on the second virtual acoustic signal, and subtracting the time-delayed second virtual acoustic signal from the first virtual acoustic signal to change directivity of the polar pattern of the first microphone and the second microphone.

15. The method as claimed in claim 13, further comprising:

calculating a source direction of the sound source according to the first acoustic signal and the second acoustic signal;

calculating a first virtual acoustic signal of a first virtual microphone located in the first position corresponding to the source direction and a second virtual acoustic signal of a second virtual microphone located in the second position opposite to the first location; and performing the time-delay process on the second virtual acoustic signal, and subtracting the time-delayed second virtual acoustic signal from the first virtual acoustic signal to change directivity of the polar pattern of the first microphone and the second microphone.

16. The method as claimed in claim 13, wherein the time-delay process virtually increases the first distance between the first microphone and the second microphone.

17. An electronic device, comprising:

at least three microphone apparatuses in claim 1, disposed in different positions of an enclosure of the electronic device; and a processor, configured to calculate a source direction of a sound source and a distance between the sound source and the electronic device according to a first acoustic signal and a second acoustic signal respectively captured by the first microphone and the second microphone in each microphone apparatus;

wherein the processor further automatically switches a polar pattern of each microphone apparatus to be directional or omni-directional according to the calculated distance between the sound source and the electronic device.

* * * * *